US008011418B2

(12) United States Patent
Rosenthal et al.

(10) Patent No.: US 8,011,418 B2
(45) Date of Patent: Sep. 6, 2011

(54) METHOD AND DEVICE FOR MANUFACTURING A METAL STRIP BY MEANS OF CONTINUOUS CASTING AND ROLLING

(75) Inventors: Dieter Rosenthal, Niederfischbach (DE); Stephan Krämer, Hilchenbach (DE); Christoph Klein, Kreuztal (DE); Jürgen Seidel, Kreuztal (DE); Wolfgang-Dietmar Hackenberg, Freudenberg (DE)

(73) Assignee: SMA Siemag Aktiengesellschaft, Duesseldorf (DE)

( * ) Notice: Subject to any disclaimer, the term of this patent is extended or adjusted under 35 U.S.C. 154(b) by 0 days.

(21) Appl. No.: 12/733,271

(22) PCT Filed: Aug. 21, 2008

(86) PCT No.: PCT/EP2008/006867

§ 371 (c)(1),
(2), (4) Date: Feb. 18, 2010

(87) PCT Pub. No.: WO2009/027045

PCT Pub. Date: Mar. 5, 2009

(65) Prior Publication Data

US 2010/0147484 A1 Jun. 17, 2010

(30) Foreign Application Priority Data

Aug. 24, 2007 (DE) ..... 10 2007 040 072
Oct. 5, 2007 (DE) ..... 10 2007 048 117
Apr. 24, 2008 (DE) ..... 10 2008 020 412

(51) Int. Cl.
*B22D 11/12* (2006.01)
*B22D 11/14* (2006.01)
*B21B 1/46* (2006.01)

(52) U.S. Cl. ..... 164/476; 164/417; 164/269; 29/527.7

(58) Field of Classification Search ..... 164/476, 164/417, 269, 513; 29/527.7, 33 C
See application file for complete search history.

(56) References Cited

U.S. PATENT DOCUMENTS 5,182,847 A 2/1993 Guse et al.
5,276,952 A 1/1994 Thomas et al.
5,307,864 A 5/1994 Arvedi et al.
5,430,930 A 7/1995 Passoni et al.
5,461,770 A 10/1995 Kimura et al.
(Continued)

FOREIGN PATENT DOCUMENTS

DE 282 185 9/1990
(Continued)

*Primary Examiner* — Kevin P Kerns
(74) *Attorney, Agent, or Firm* — Abelman, Frayne & Schwab

(57) ABSTRACT

A method of manufacturing a metal strip includes casting a slab (3) or preliminary strip (3') in a casting machine (2) and subsequently rolling the cast slab (3) or preliminary strip (3') in at least one rolling train (4, 5) in a first operating mode with the at least one rolling train being connected with the casting machine for continuously manufacturing the metal strip, and in a second operating mode removing the cast slab (3) or preliminary strip (3') from the main transport line (6) with a shuttle system arranged between the casting machine (2) and the at least one rolling train (4, 5), storing the removed slab (3) or preliminary strip (3'), and subsequently transporting the removed slab (3) or preliminary strip back into the main transport line, with the removed slab (3) or preliminary strip (3') being heated to a desired temperature or maintained at a desired temperature prior to the transport back into the main transport line (6) for discontinuously manufacturing the metal strip.

18 Claims, 6 Drawing Sheets

U.S. PATENT DOCUMENTS

| | | | | |
|---|---|---|---|---|
| 5,634,257 | A | 6/1997 | Kajiwara et al. | |
| 5,769,149 | A | 6/1998 | Mertens | |
| 5,810,069 | A | 9/1998 | Flick et al. | |
| 5,842,367 | A | 12/1998 | Rohde | |
| 6,071,362 | A | 6/2000 | Mertens | |
| 6,149,740 | A * | 11/2000 | Bald et al. | 148/544 |
| 6,199,620 | B1 | 3/2001 | Benedetti et al. | |
| 6,978,531 | B1 | 12/2005 | Che et al. | |
| 7,152,661 | B2 * | 12/2006 | Flemming et al. | 164/477 |
| 2006/0243420 | A1 | 11/2006 | Flemming et al. | |
| 2008/0276679 | A1 | 11/2008 | Eckerstorfer et al. | |
| 2009/0056906 | A1 | 3/2009 | Arvedi | |

FOREIGN PATENT DOCUMENTS

| | | |
|---|---|---|
| DE | 10 200 50 11254 | 1/2007 |
| DE | 10 2006 002 505 | 5/2007 |
| EP | 0665296 | 8/1995 |
| EP | 1113888 | 8/2002 |
| EP | 1960131 | 8/2008 |
| JP | 58 006701 | 1/1983 |
| JP | 10 175001 | 6/1998 |
| WO | WO 98/56517 | 12/1998 |
| WO | WO 2007/072516 | 6/2007 |

* cited by examiner

METHOD AND DEVICE FOR MANUFACTURING A METAL STRIP BY MEANS OF CONTINUOUS CASTING AND ROLLING

BACKGROUND OF THE INVENTION

1. Field of the Invention

The invention pertains to a method for manufacturing a metal strip by means of continuous casting and rolling, wherein a thin slab is initially cast in a casting machine and this thin slab is subsequently rolled in at least one rolling train by utilizing the primary heat of the casting process, wherein a continuous manufacture of the metal strip (continuous rolling) can be realized in a first operating mode by directly coupling the casting machine to the at least one rolling train, and wherein a discontinuous manufacture of the metal strip (batch rolling) can be realized in a second operating mode by decoupling the casting machine from the at least one rolling train. The invention furthermore pertains to a device for manufacturing a metal strip by means of continuous casting and rolling.

2. Description of the Prior Art

Continuous thin slab/thin strip casting and rolling systems of this type are known as CSP-systems. The continuous rolling out of the casting heat has been known for quite some time, but not yet prevailed in the market. The rigid connection between the continuous casting machine and the rolling train, as well as the march of temperature through the entire system, proved to be difficult to manage. The continuous rolling out of the casting heat is known from EP 0 286 862 A1 and EP 0 771 596 B1. The casting process and the rolling process are directly coupled in this case. The continuous strip is severed by means of shears shortly before the coiler.

Similar methods for the continuous manufacture of steel strips by coupling the casting machine and the rolling train to one another are disclosed in EP 0 415 987 B2 and EP 0 889 762 B1. In order to solve the temperature problems at the relatively slow transport speed, inductive heaters are provided upstream of and within the rolling train in these publications.

An alternative technology is the rolling of individual slabs and individual strips. In the discontinuous rolling of strips, the casting process and the rolling process are decoupled from one another. The casting speed is usually very slow and the rolling process is realized independently thereof with a high speed, namely in such a way that the temperature for the final forming process lies above the minimum temperature. Systems of this type are also referred to as CSP-systems and described, for example, in EP 0 266 564 B1, in which a high reduction is realized in the thin slab system.

A similar thin slab system is also disclosed in EP 0 666 122 A1, wherein strips are discontinuously rolled by utilizing inductive heating between the first finishing stands.

The advantage of discontinuous rolling can be seen in that the casting speed and the rolling speed can be adjusted independently of one another. When rolling thin strips, it is possible, e.g., to flexibly adjust higher rolling speeds, namely even if the casting machine operates with a slower speed or its speed is currently adjusted.

Both methods—namely the continuous casting and rolling on one hand and the discontinuous casting and rolling on the other hand—are difficult to combine due to the above-described circumstances.

SUMMARY OF THE INVENTION

The invention is based on the objective of additionally developing a method of the initially cited type and developing a corresponding device that make it possible to increase the flexibility of the method and the device. It should be possible, in particular, to continue the casting process without interruptions if a malfunction occurs or brief maintenance procedures are required in the rolling train or during other interruptions of the rolling process, wherein this ability provides significant economical advantages and advantages with respect to the process control.

With respect to the method, this objective is attained, according to the invention, in that cast slabs or preliminary strips are removed from the main transport line downstream of the casting machine referred to the strip transport direction in the discontinuous manufacture (i.e., rolling) of the metal strip, stored and subsequently transported back into the main transport line, wherein the removed slabs or preliminary strips are heated to a desired temperature or maintained at a desired temperature prior to the transport back into the main transport line.

In this case, a special shuttle system consisting of two or more partial systems is preferably used in succession.

In this case, it is particularly preferred that slabs cast during the continuous operation of the casting machine are removed from the main transport line during a roll exchange in the rolling train and transported back into the main transport line at a later time. This makes it possible to exchange a roll without having to forgo the continuous operation of the casting machine.

One proposed device for manufacturing a metal strip by means of continuous casting and rolling features a casting machine, in which a thin slab is initially cast, and at least one rolling train that is arranged downstream of the casting machine and in which the thin slab is rolled by utilizing the primary heat of the casting process. The invention is characterized in that a shuttle system is arranged downstream of the casting machine referred to the strip transport direction and designed for transporting cast slabs out of and into the main transport line. A heating means is preferably arranged on or in the shuttle system in order to heat the slabs to a desired temperature.

This heating means is advantageously realized in the form of an inductive heater and/or a furnace that is heated with fuel (e.g., gas, oil). The shuttle system may comprise transport elements for moving the slabs transverse to the strip transport direction. These transport elements may comprise movable carriages. Alternatively, the transport elements could also consist of walking beam transport elements.

According to one additional development of the invention, the shuttle system consists of two or more (e.g., 3 or 4) partial systems that are arranged in succession in the strip transport direction. These partial systems can be displaced transverse to the strip transport direction jointly or independently of one another. Within these partial systems of the shuttle system, it is possible to realize a longitudinal transport from one partial system to another partial system in the strip transport direction or opposite thereto (i.e., forward or backward).

The shuttle system is preferably arranged between the casting machine and the rolling train. However, it may also be advantageous to arrange the shuttle system between a roughing train or a roughing stand and a finishing train.

The shuttle system may furthermore be realized such that it can be connected to a roller table for storing slabs. In this case, the roller table may be provided with heat insulation. A heating means may be arranged between the roller table and the shuttle system.

At least one auxiliary storage means, e.g., in the form of a holding pit or a similar device, may be arranged adjacent to the roller table in order to store slabs or preliminary strips.

This makes it possible to expand the storage capacity or to realize a prolonged storage time so as to influence the microstructure. This may also be advantageous for metallurgic reasons, namely if prolonged storage times should be realized in the holding pit that acts as a storage means.

Slab shears or preliminary strip shears may be arranged upstream of the shuttle system referred to the strip transport direction.

The advantages of the continuous technique, i.e., the continuous operation of the proposed casting and rolling system, in connection with the CSP-technology can be seen in the following characteristics: the structural length of the system is reduced such that the investment costs are lowered. Energy savings can be achieved due to the consequent direct use. In addition, the yield strength is reduced due to the slower rolling speed. It is possible to manufacture products that are difficult to roll and, e.g., very thin (ultrathin) strips (strip thickness approximately 0.8 mm) in large quantities. It is furthermore possible to process special materials (high-strength materials). A combination of wide and thin strips can also be processed. Rolling defects on the strip ends and therefore damages to the rolls can be prevented or at least reduced. The malfunction rate of the system can be reduced and upstrokes can be prevented.

BRIEF DESCRIPTION OF THE DRAWINGS

Embodiments of the invention are illustrated in the drawings. In these drawings.

DETAILED DESCRIPTION OF THE PREFERRED EMBODIMENTS

Figure 1:
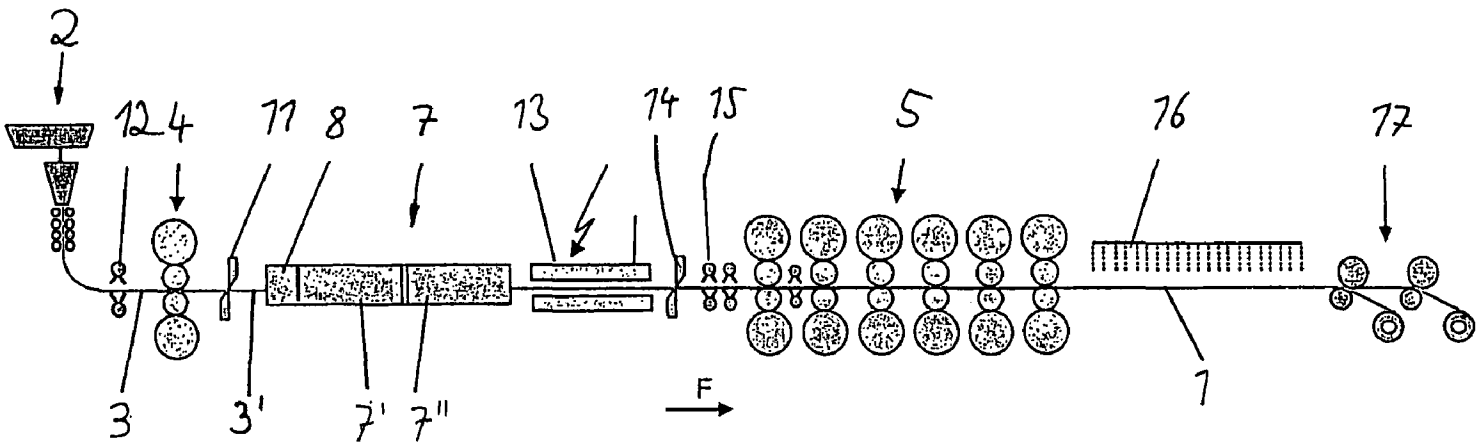
FIG. 1 schematically shows a side view of a casting and rolling system according to a first embodiment of the invention.
Figure 2:
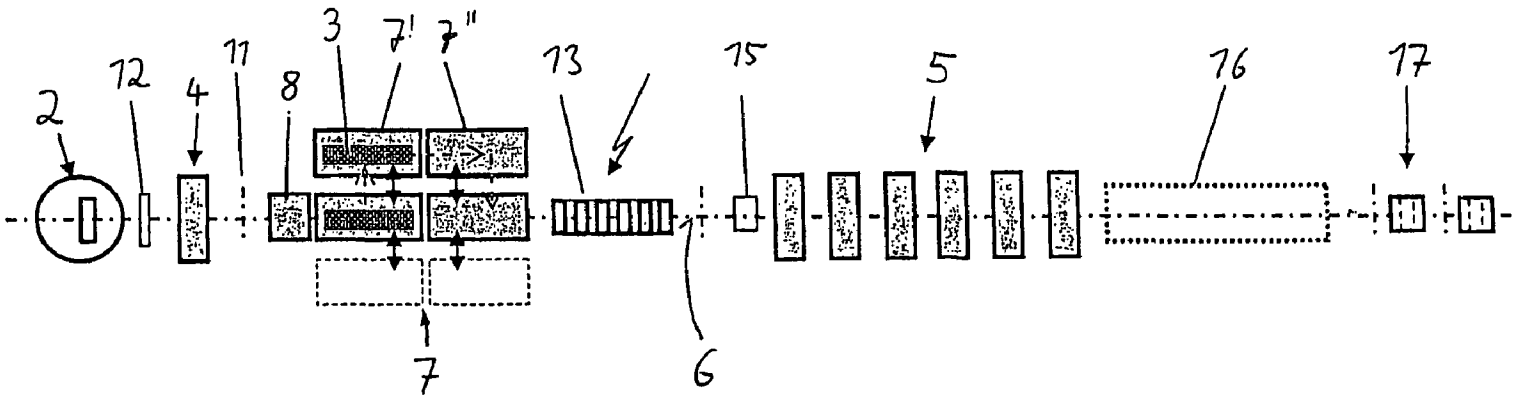
FIG. 2 shows a top view of FIG. 1.
Figure 3:
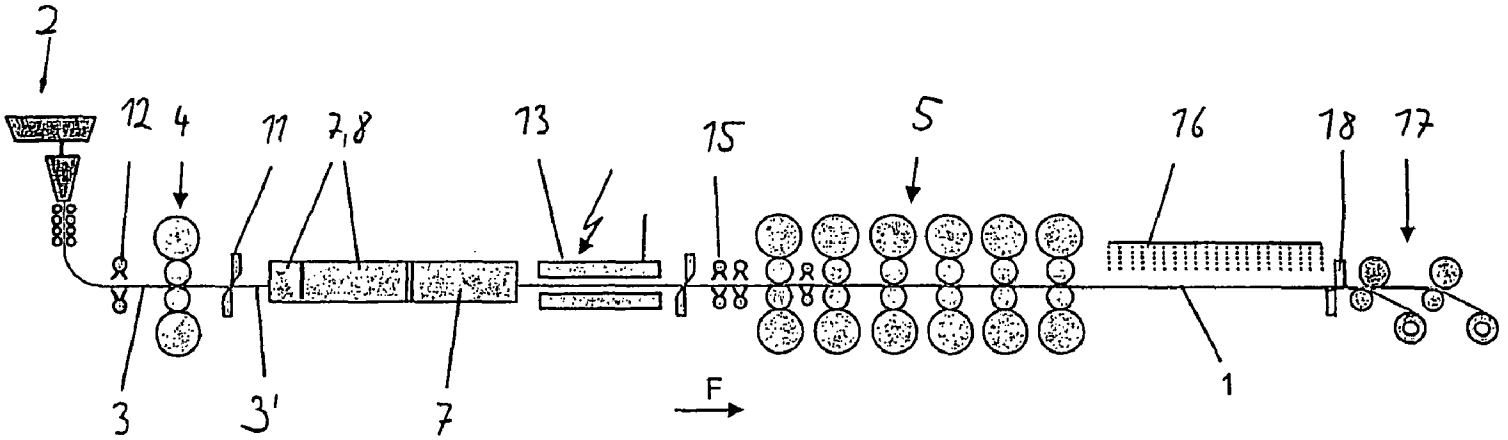
FIG. 3 shows a casting and rolling system according to an alternative embodiment of the invention in the form of an illustration analogous to FIG. 1.

FIG. 1 and FIG. 2 show a continuous casting and rolling system, in which a metal strip 1 is manufactured. To this end, a thin slab 3 is initially cast in a conventional casting machine 2 and then transported to a rolling train 4, 5 that consists of a roughing train 4 (that features one or more stands) and a finishing train 5. The casting machine 2 features a strand cooling system that is divided into narrow cooling zones in order to realize a temperature zone control over the width of the strip and to thusly adjust a homogenous temperature at the outlet of the continuous casting system.

The continuous casting and rolling system also features various other elements that are generally known in systems of this type. A descaling sprayer 12 is arranged downstream of the casting machine 2 referred to the strip transport direction F in order to clean the slabs. Strip shears 11 are positioned directly downstream of the roughing train 4. The shears are used for separating the dummy bar at the gate, for severing the slabs (usually individual slabs or half slabs) and for cutting the strip during malfunctions.

A shuttle system 7 arranged downstream thereof is described in greater detail below.

A furnace 13 is arranged downstream of the shuttle system 7 and preferably realized in the form of an induction furnace; however, this furnace may also consist of a roller hearth furnace. It is furthermore possible to divide the induction heater shown. It would even be conceivable to provide an induction heater upstream and downstream of the shuttle system. Additional strip shears 14 and an additional descaling sprayer 15 are arranged downstream thereof. The shears 14 serve as emergency shears or for profiling the shape of the slab ends.

A cooling section 16 is arranged downstream of the finishing train 5. The coiler 17 is situated downstream thereof. The finishing train 5 frequently comprises three to eight stands, preferably six stands. In this finishing train, the preliminary strip is rolled down to a final thickness of, for example, approximately 0.8 to 16 mm.

The following should be noted with respect to the shuttle system 7: in the solution according to FIGS. 1 and 2, heatable shuttles or furnace parts are provided—as shown in FIG. 2—as additional storage means for briefly storing the slabs, for example, during the time required for a roll exchange in the finishing train, wherein slabs 3 or divided slabs and preliminary strips 3' can be removed from the main transport line 6 in order to be stored and subsequently reinserted into this main transport line. In this case, the shuttle elements are indicated in the form of carriages that can be moved transverse to the strip transport direction F in order to transport slabs out of and into the main transport line 6. Alternatively, it would also be possible to utilize a walking beam conveyor adjacent to the main transport line 6 instead of a shuttle carriage. The slab temperature is usually maintained during the transport by means of the shuttle or the furnace. At slow casting speeds, a slab heating system is provided in order to flexibly adjust nearly constant input temperatures for the ensuing processes.

These figures also show that two partial shuttle systems 7' and 7" are provided in succession referred to the strip transport direction F. These partial systems may advantageously have a total length that corresponds to the length of a slab with maximum weight of coil plus a slight allowance for pendulum motions. Consequently, the shuttle or furnace zone is realized relatively short.

FIGS. 3 and 4, FIGS. 5 and 6 and FIGS. 7 and 8 show variations of the solution according to FIGS. 1 and 2. In the solution according to FIGS. 3 and 4, additional shuttles 7 are provided, wherein a slab transport in or opposite to the strip transport direction F may also be realized within the shuttles or outside the main transport line 6 (see double arrows in the strip transport direction F in FIG. 4).

Figure 5:
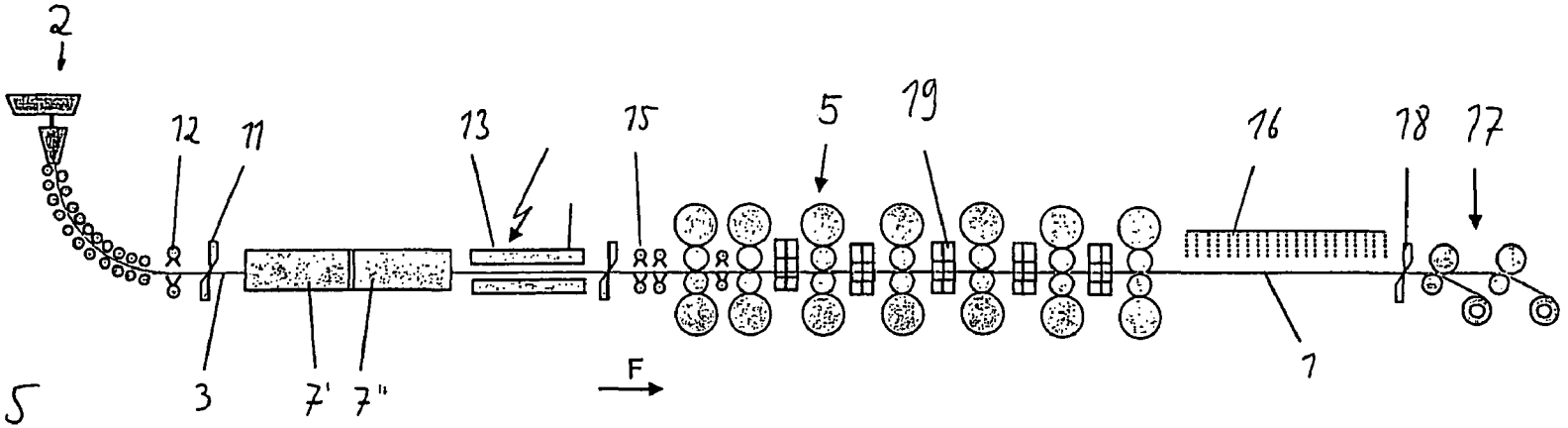
FIG. 5 shows a casting and rolling system according to another alternative embodiment of the invention in the form of an illustration analogous to FIG. 1.
Figure 6:
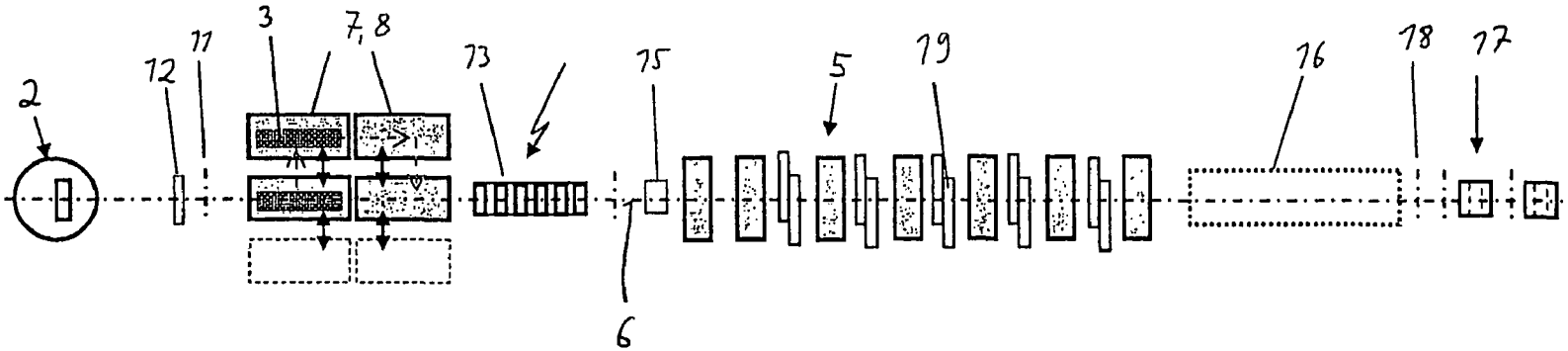
FIG. 6 shows a top view of FIG. 5.

In the embodiment according to FIGS. 5 and 6, the shuttle system is arranged directly downstream of the casting machine—i.e., upstream of the rolling train. Furthermore, additional induction heaters 19 are arranged between the roll stands of the finishing train 5 for the continuous mode.

Figure 7:
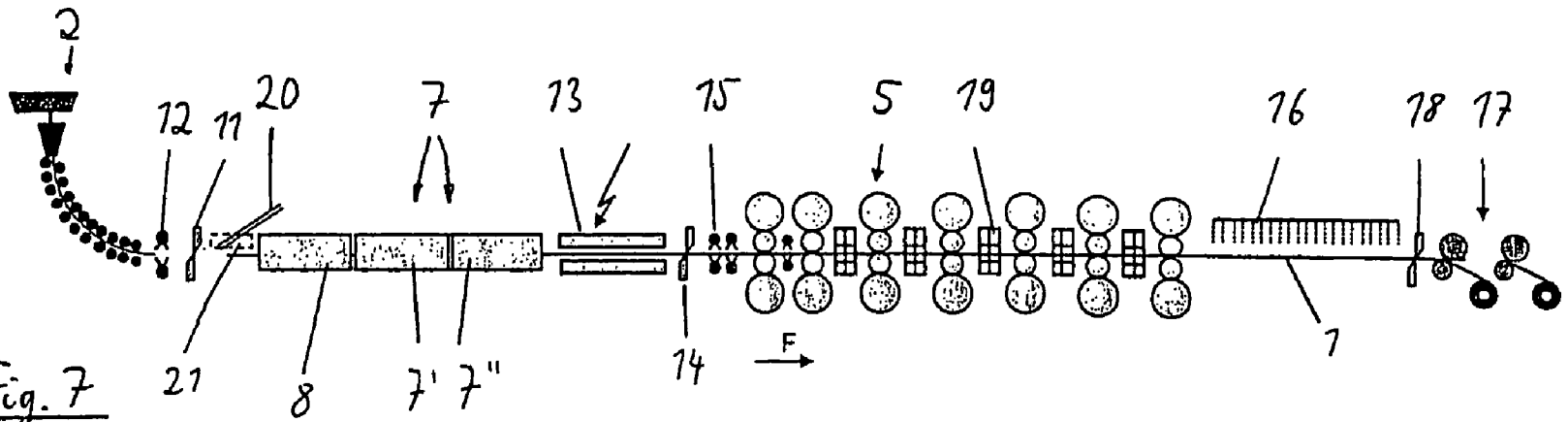
FIG. 7 shows a casting and rolling system according to another alternative embodiment of the invention in the form of an illustration analogous to FIG. 1.
Figure 8:
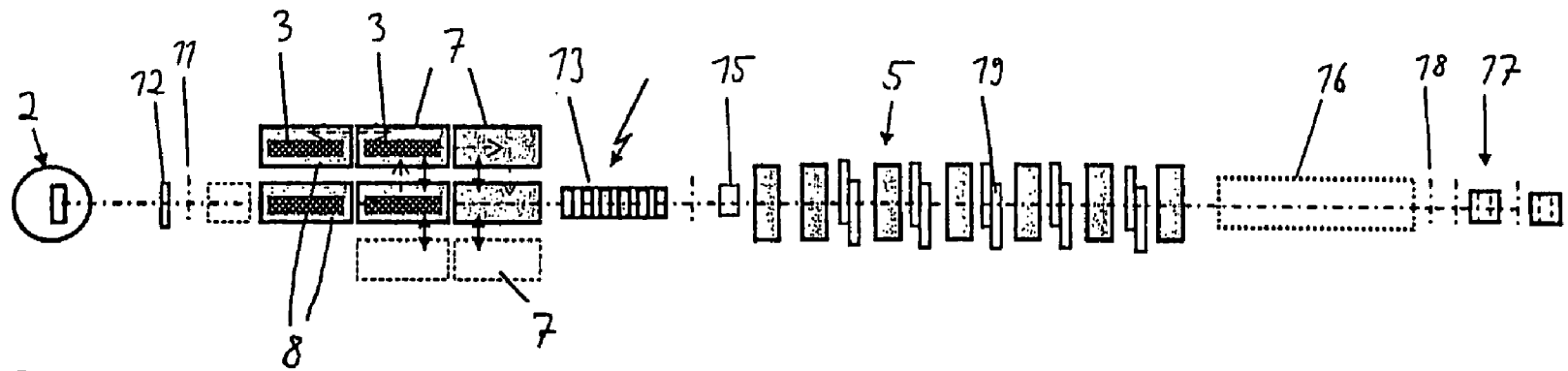
FIG. 8 shows a top view of FIG. 7.

In FIG. 7, a dummy bar disposal 20 is indicated for removing the cut-off dummy bar. A "boom" or a chain makes it possible to upwardly or laterally remove this dummy bar from the transport line at the gate by means of a displacing unit. After this process, a roller table cover 21 can be pivoted down in order to reduce the temperature loss.

Figure 9:
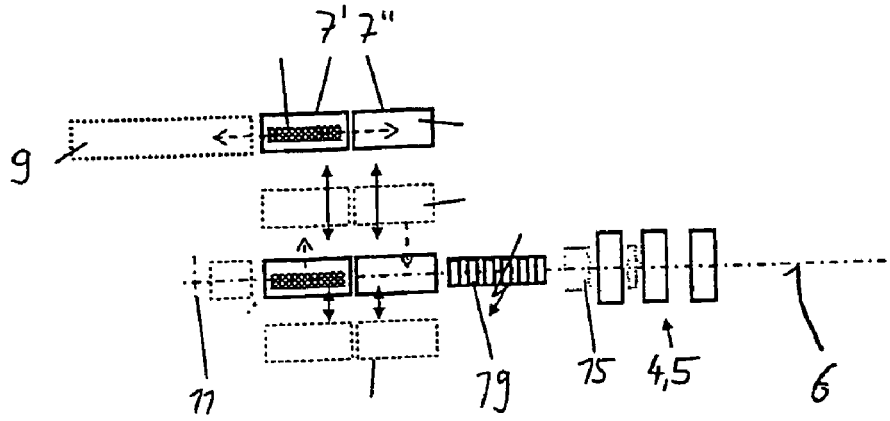
FIG. 9 shows the region of a shuttle system in the form of a detail of a top view of a casting and rolling system.

FIG. 9 shows another embodiment of the furnace/shuttle arrangement 7/8. In this case, it is possible to push slabs 3 or half slabs on an auxiliary roller table 9 during an extended malfunction. A prolonged storage time of the slabs or preliminary strips is also required for metallurgic reasons (crystalline structure).

Figure 11:
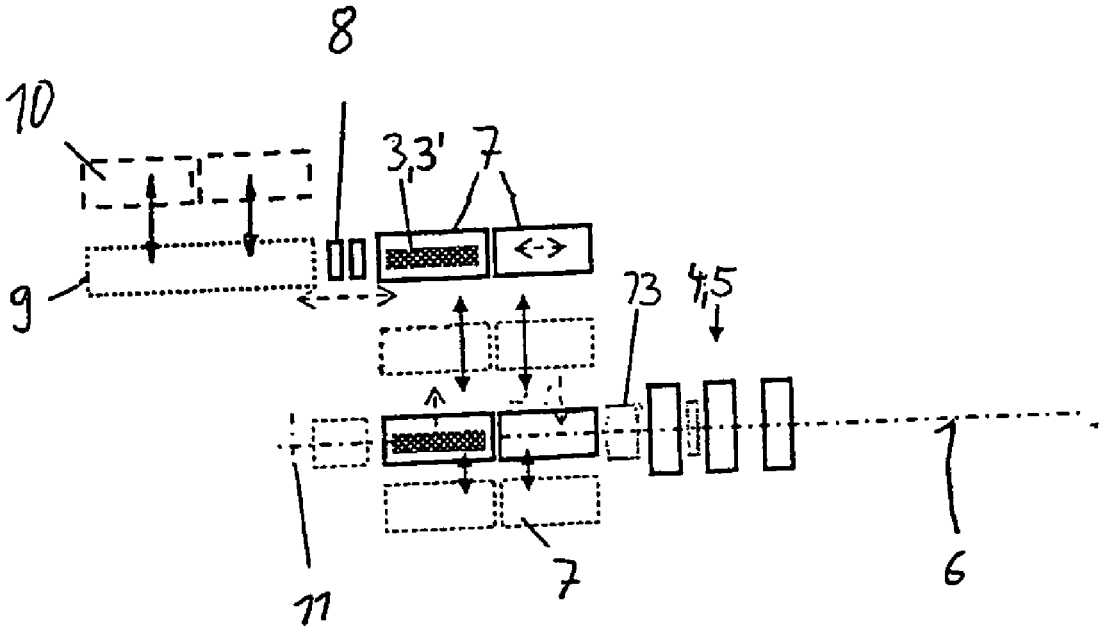
FIG. 11 shows another alternative embodiment of the shuttle system in the form of an illustration analogous to FIG. 9.

These slabs or preliminary strips can then—as shown in FIG. 11—be optionally stored in holding pits 10 and subsequently reinserted into the transport line and rolled out as indicated in FIG. 11. FIG. 11 also shows parking positions of the shuttles that are illustrated on the bottom with broken lines, as well as storage positions of the shuttles that are illustrated with broken lines between the main transport line 6 and the shuttles illustrated on top. The slabs 3 or preliminary strips 3' are pushed off in the uppermost position of the shuttles 7.

Depending on the system variation, it is possible to operate with or without a rigid furnace section upstream of the shuttle 7. This also applies to the induction heater or the roller hearth furnace 13 arranged downstream of the shuttle. A pendulum motion of the slab 3 may take place between the roller table 9 and the shuttles 7 situated adjacent thereto on the right side in order to heat the slab 3 by means of the induction heater 8. The roller table 9 can be encapsulated for heat insulation purposes.

The subsequent reheating can be optionally realized in an inductive fashion with a heating means 8, e.g., a gas-fired or oil-fired roller hearth furnace.

Figure 10:
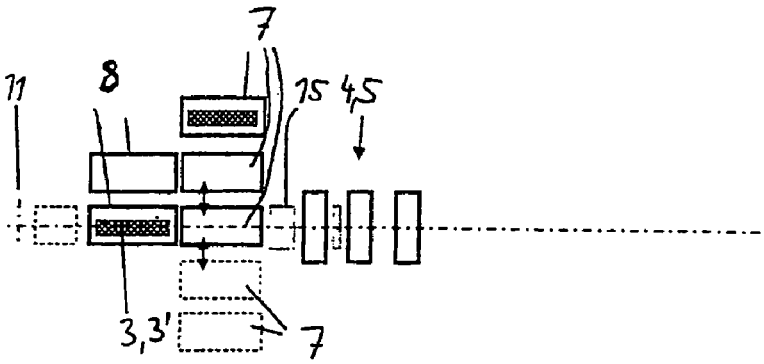
FIG. 10 shows an alternative embodiment of the shuttle system in the form of an illustration analogous to FIG. 9.

According to FIG. 10, a short embodiment of the furnace/shuttle arrangement is also achieved, e.g., if three or more shuttles 7 are provided adjacent to one another.

The heating means 19 (in FIG. 9) or the heating means 13 (in FIG. 2 or 6) that is preferably realized in the form of an induction heater makes it possible to individually heat the preliminary strip to the desired finishing train inlet temperature. This is realized, for example, in order to adjust higher temperatures (e.g., 1350° C.) during the rolling of grain oriented silicone steel (GO-Si-Steel) or other materials, in order to adjust higher temperatures during the rolling of thin strips (H smaller than 1.5 mm) or in order to increase the temperatures if the temperature of the thin slab is excessively low. If low temperatures are desired, it would naturally also be possible to operate without introducing energy and or only little energy, for example, if energy should be saved during the processing of normal strips.

Furthermore, the heating means 8, 13 and 19 make it possible to realize homogenous temperatures over the length of the thin slabs and to compensate possible temperature nonuniformities by means of a varying introduction of energy over the length.

If the system is operated with a relatively slow casting speed and therefore rolling speed in the rolling train in the continuous mode, the induction heater is required for adjusting a sufficiently high rolling temperature. The induction heater arranged upstream of the finishing train may optionally be supplemented with induction heaters within the finishing train. The induction heater upstream of the finishing train is optionally realized such that it can be transversely displaced or pivoted upward in order to replace the induction heater with a (passive or heated) roller table cover or a conventional furnace section, if so required.

The strip shears 18 in FIG. 5 serve for cutting the strips directly upstream of the coiler 17 when the system is operated in the continuous mode.

The arrangement of the shuttle system 7 may be realized directly downstream of the casting machine 2 (as illustrated in FIGS. 5 to 8). However, it is also possible (as illustrated in FIGS. 1 to 4) to initially carry out a thickness reduction in one or more stands (see roughing train 4) downstream of the casting machine 2 and to install the shuttle system 7 downstream thereof.

The holding furnace 13 arranged downstream of the casting machine 2 may also be realized in the form of a conventional gas-fired furnace.

According to the embodiment shown in FIG. 1, the roughing train 4 features one roll stand while the finishing train 5 features six roll stands. The furnace 13 in the form of an induction furnace is arranged between the roughing train 4 and the finishing train 5 in order to heat the strip to the optimal strip temperature subsequent to the preliminary rolling in the roughing train 4 and prior to the finish rolling in the finishing train 5.

The strip shears 11 are used for severing the thin slabs 3 in the discontinuous mode and the strip shears 14 are used for severing the strips in the continuous rolling mode. The shears 11 serve, in particular, for cropping the strip head or strip end during the start or the outward transport in the continuous mode or in the discontinuous mode.

The utilization of the proposed system types makes it possible to selectively realize a coupled, fully continuous casting/rolling process (continuous rolling) and a decoupled, discontinuous processing of individual slabs (batch rolling).

In continuous rolling, the level of the casting speed defines the march of temperature through the entire system. Depending on the casting speed, a computer model dynamically controls the heating power of the furnaces arranged upstream and within the rolling train in such a way that the rolling train outlet temperature reaches the target temperature.

If the casting speed falls short of a certain predefined threshold value (when problems occur in the casting system, when processing materials that are difficult to cast, during the starting process, etc.), the system is automatically switched over from the continuous mode to the discontinuous rolling mode, i.e., the thin slab 3 is severed by means of the shears 11 and 14 and the rolling speed is increased such that the desired final rolling temperature is reached. During this process, the slab segments or strip segments are tracked within the train 4, 5 and the transport and rolling speeds, as well as the inductive heating power, are dynamically adapted over the strip length depending on the temperature distribution.

Once the casting process has stabilized again and the casting speed exceeds the predefined minimum value, the system is analogously switched back from the discontinuous mode into the continuous mode.

The option to randomly adjust or switch over between the continuous mode and the discontinuous mode provides a high degree of flexibility that represents an improved process reliability. This applies, in particular, to the startup of a production system.

The continuous processing mode is not generally used; the batch mode is primarily used during casting speed problems or during the starting process.

In order to realize an energy optimization, it is possible to roll, in particular, thinner strips or strips that are difficult to produce in the continuous mode and strips with a thickness that exceeds a critical thickness in the batch mode at faster speeds and therefore with a low heating power consumption.

The correct combination of the production type optimizes the energy balance of the continuous/batch CSP-system for the entire product range.

The utilization of the proposed system types makes it possible to selectively realize a coupled, fully continuous casting/rolling process (continuous rolling) and a decoupled, discontinuous processing of individual slabs in the batch mode. The system has a very space-saving design. The system length (approximately 250 m) only amounts to approximately half the length of a conventional CSP-system. However, the proposed system still makes it possible to exchange a working roll without having to interrupt the casting process.

The following should be noted with respect to the possible operating modes of the proposed system:

1. Batch-Mode in the Rolling Train:

At the beginning of the casting process, during the startup of the system, during general casting problems or when processing steels that are difficult to cast, the casting speed is adjusted relatively slow. At slow casting speeds, the continuous rolling with this low mass flow from the casting system to the finishing train is not possible or uneconomical for temperature reasons. The batch mode is preferably used in order to reduce the energy losses. In the batch mode, the casting process and the finish rolling are respectively decoupled and therefore take place with a different speed (i.e., mass flow). After the casting process begins, the dummy bar is initially disposed and the thin slab is cropped in the region of the slab head. After the desired coil weight is reached, each slab is cropped with the shears downstream of the continuous casting system or the roughing train, respectively. Subsequently, the slabs are rolled in the finishing train with an individually adjustable rolling speed, transported through the cooling section and ultimately coiled up.

2. Continuous Mode (i.e., Casting Machine and Rolling Train are Coupled)

The system is switched over into the continuous mode as the casting speed increases and in dependence on the final thicknesses to be rolled. In this operating mode, the shears upstream of the coiler are used for severing the strips. Before the thin slab is introduced into the finishing train, it is inductively heated such that a sufficiently high rolling temperature is adjusted and the rolling takes place in the austenitic range. During the subsequent finish rolling, the inductive heaters within the finishing train are usually also utilized in order to supplement the inductive heaters upstream of the finishing train. However, in the discontinuous mode or during the starting process on the strip head, they are situated in a safe waiting position far above or adjacent to the strip.

3. Roll Exchange in the Finishing Train During Active Casting Process

The casting process preferably should not be interrupted or disturbed during an exchange of the working rolls or during malfunctions in the rolling train. It is therefore sensible to install a buffer for the slabs. For this purpose, a short roller hearth furnace is provided downstream of the casting machine in a compact CSP-system, wherein said roller hearth furnace can accommodate four (or six) slabs depending on the process. The furnace is realized in the form of the proposed shuttles as illustrated, in particular, in FIGS. 9 to 11.

According to the figures, two shuttle groups 7', 7" are arranged in succession referred to the transport direction, wherein both shuttle groups can be transversely displaced independently of one another. Alternatively, the front shuttle group 7' may be rigidly installed downstream of the casting machine 2 or the roughing train 4 in the form of a furnace section. For example, a total of four full or half thin slabs can be accommodated in these two shuttle groups. Storage capacities are optionally provided in short furnace sections. The fields drawn with broken lines in FIGS. 2, 4, 6 and 8 to 11 indicate siding/parking positions for the shuttles 7, 7', 7". It is also possible to realize a transport of slabs from shuttle to shuttle adjacent to the rolling line such that the transport of slabs back into the rolling line can be realized individually with one shuttle or another shuttle. This arrangement simplifies the flexible transport of slabs back into the rolling line after an interruption of the rolling process (i.e., particularly during a roll exchange or during a malfunction). In an alternative embodiment, it would also be conceivable to realize the second shuttle group in the form of more than two shuttle parts or walking beam furnace sections (for example, three or four such sections) that are arranged adjacent to one another in order to increase the storage capacity of a system with the same the overall length.

Figure 4:
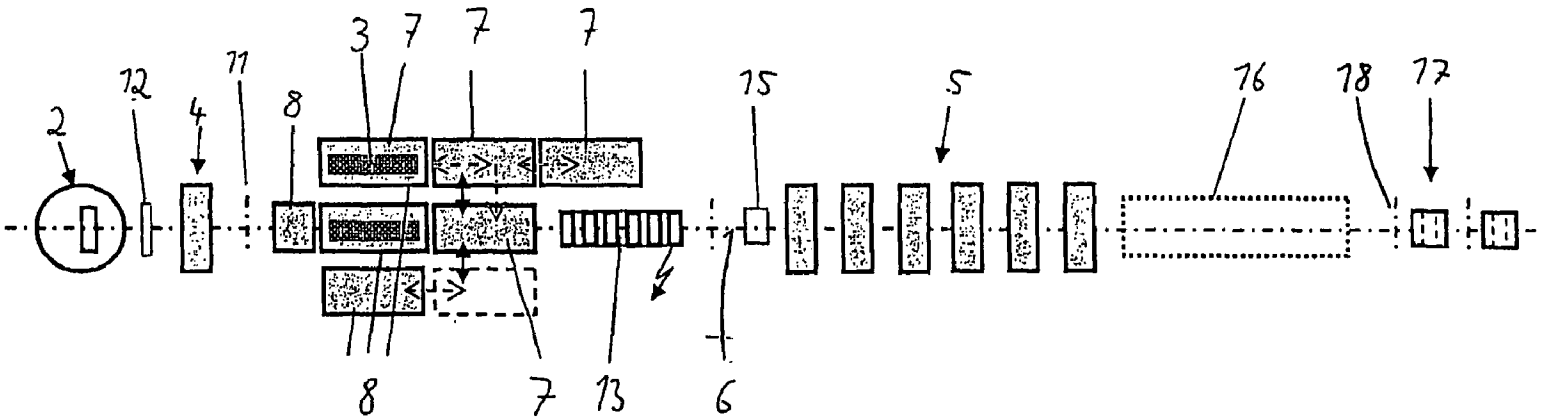
FIG. 4 shows a top view of FIG. 3.

FIG. 4 shows a constellation of furnaces and shuttles in a short continuous casting and rolling system, wherein three adjacently arranged furnaces 8 are charged by one shuttle 7.

If the shuttles (furnaces) are full, e.g., because the interruption of the rolling process lasts for an extended period of time, the slabs can be pushed off on a roller table 9 (see FIGS. 10 and 11), stored, reheated and subsequently reinserted into the main transport line 6 and rolled out.

The storage of half slabs (i.e., a compromise during a roll exchange) simplifies the filling of gaps between two strips at a short structural length such that slabs can be easily transported out of or into the transport line 6 with a shuttle. In the normal mode, however, the overall length of both shuttles makes it possible to maintain a slab warm over its entire length.

During the roll exchange, the casting speed is optionally reduced in order to increase the buffer time.

It is preferred to provide a 1-strand casting system with pendulum-type or transverse shuttles in order to store a thin slab or formed thin slab in a shuttle and/or parallel furnaces, e.g., during a roll exchange.

In order to carry out the roll exchange, the system is previously switched over from the continuous mode into the batch mode.

Within the shuttles that stand adjacent to the main transport line 6, it is also possible to realize the longitudinal transport of slabs from one shuttle to another shuttle (in this context, see the double arrow in the direction of the strip transport direction F in FIG. 4).

Consequently, the proposed invention makes it possible to utilize the advantages of a continuous casting and rolling process, as well as those of a batch rolling process.

The transformation costs (rolling energy, heating energy) can be lowered, and the structural length of the system can be reduced by approximately 40% to 50% in comparison with the CSP-technology. The investment costs and the operating costs are also lowered accordingly.

Continuous rolling reduces the number of initial passes in the finishing train, wherein this is particularly advantageous when rolling thin final thicknesses. The cast slab passes, for example, through two inline roll stands, in which it is reduced to a suitable preliminary strip thickness for producing the final product with the smallest possible number of finishing stands.

The preliminary strip temperature can be maintained at the level of the outlet temperature of the inline-stands in a roller hearth furnace. An inductive heater upstream and, optionally, within the finishing train increases this temperature to the required rolling temperature.

It is advantageous to provide inductive heating systems upstream and within the finishing train because only relatively slow rolling speeds can be realized in the continuous mode. In this case, the temperature loss without inductive heating system would be greater than that permitted up to the end of the finishing train in order to observe the finish rolling temperature.

The proposed method also allows the rolling of individual strips known from the CSP-process. For this purpose, the preliminary strip is divided into the desired lengths downstream of the inline stands by means of pendulum shears. This makes it possible to manufacture a multitude of steel qualities that need to be cast with a slower casting speed due to metallurgic requirements. At these slow casting speeds, a continuous rolling process is not economical. The reheating power required for observing the finish rolling temperature is excessively high. In addition, the advantages of the continuous rolling process do not apply to steel qualities manufactured with this method because these products are manufactured in conventional finished strip thicknesses.

The continuous casting process preferably should not be disturbed during a roll exchange in the finishing train. This is the reason why it is necessary to install the proposed system for buffering the preliminary strips, wherein this system makes it possible to provide the required buffer time without impairing the quality of the preliminary strip. The uniformity of the preliminary strip temperature is one distinguishing characteristic of the CSP-technology and a prerequisite for a multitude of advantages during the subsequent finish rolling process. The roller hearth furnace is a suitable solution in this respect. In the present instance, the roller hearth furnace is essentially designed for accommodating approximately four half preliminary strip lengths and provides a buffer in the length of the required roll exchange time if the preliminary strips are transversely displaced and stored therein.

The described concept represents a one-strand concept. It would be possible to expand the system to two casting strands. If the system is designed in the form of a one-strand system, the capacity of the system components is utilized. This generally results in favorable investment and operating costs.

Typical data for the proposed concept are casting thicknesses between 60 and 100 mm, casting speeds between 4 m/min and 8 m/min, preliminary strip thicknesses between 25 mm and 60 mm and finished strip thicknesses between 1.0 and 16 mm.

| List of Reference Symbols: | |
|---|---|
| 1 | Metal strip |
| 2 | Casting machine |
| 3 | Thin slab |
| 3' | Preliminary strip |
| 4, 5 | Rolling train |
| 4 | Roughing train |
| 5 | Finishing train |
| 6 | Main transport line |
| 7 | Shuttle system |
| 7' | Partial system |
| 7" | Partial system |
| 8 | Heating means (induction heater or roller hearth furnace) |
| 9 | Roller table |
| 10 | Holding pit/auxiliary storage |
| 11 | Strip shears |
| 12 | Descaling sprayer |
| 13 | Furnace (induction furnace or roller hearth furnace) |
| 14 | Strip shears |
| 15 | Descaling sprayer |
| 16 | Cooling section |
| 17 | Coiler |
| 18 | Strip shears |

-continued

| List of Reference Symbols: | |
|---|---|
| 19 | Heating means (induction heater) |
| 20 | Dummy bar disposal |
| 21 | Roller table cover |
| F | Strip transport direction |

The invention claimed is:

1. A method of manufacturing a metal strip from a cast slab or preliminary strip, comprising the steps of providing a device including a casting machine (2), at least one rolling train (4, 5), and a shuttle system (7) arranged in a main transport line (6) connecting the casting machine (2) with the at least one rolling train (4, 5), between the casting machine (2) and the at least one rolling train (4, 5) and formed of at least two shuttles (7', 7") capable of being displaced transverse to a transport direction (F) of a strip-forming thin slab (3) or preliminary strip (3) along the main transport line (6); casting the slab (3) in the casting machine (2) or producing a preliminary strip (3'); transporting the cast slab (3) or the preliminary strip (3') along the main transport line (6) from the casting machine (2) to the at least one rolling mill train (4, 5), and subsequently rolling the cast slab (3) or preliminary strip (3') using primary heat of a casting process in a first operating mode for continuously manufacturing the metal strip; and in a second operating mode, for batch manufacturing the metal strip, removing the cast slab (3) or preliminary strip (3') from the main transport line (6) by displacing one or both of the shuttles (7', 7"), in which the cast slab (3) or preliminary strip (3') is stored, transverse to the main transport line (6), whereby the at least one rolling mill train (4, 5) becomes decoupled from the casting machine (3); heating the removed cast slab (3) or preliminary strip (3') to a desired temperature or maintaining the removed cast slab (3) or preliminary strip (3') at the desired temperature prior to transporting the removed cast slab or preliminary strip back into the main transport line (6) by the one or both of the shuttles (7', 7").

2. A method according to claim 1, comprising the steps of removing the cast slab (3) or preliminary strip (3') from the main transport line (6) in the fist operating mode during roll exchange in the at least one rolling train (4, 5), and transporting the removed slab or preliminary strip back into the main transport line (6) at a later time.

3. A device for manufacturing a metal strip from a cast slab or preliminary strip, comprising a casting machine (2) for casting a slab (3) or preliminary strip (3'); at least one rolling train (4, 5) arranged downstream of the casting machine (2) and in which the slab (3) is rolled by utilizing the primary heat of the casting process; and a shuttle system (7) arranged in a main transport line (6) connecting the casting machine (2) with the rolling train (4, 5) between the casting machine (2) and the at least one rolling train (4, 5) and formed of at least two shuttles (7', 7") adapted to store the cast slab or preliminary strip and arranged one after another and capable of being displaced transverse to a transport direction (F) of the cast slab (3) or preliminary strip (3') along the main transport line (6) independently from each other for transporting the cast slab (3) or preliminary strip (3') out off and into the main transport line (6).

4. A device according to claim 3, comprising a roughing train (4) located downstream of the casting machine (2), and wherein the shuttle system (7) is located downstream of the roughing train (4).

5. A device according to claim 3, wherein the shuttle system (7) comprises heating means (8) for heating the removed cast slab (3) or preliminary strip (3') to a desired temperature or for maintaining the removed cast slab (3) or preliminary strip (3') at a desired temperature.

6. A device according to claim 5, wherein the heating means (8) is realized as an inductive heater and/or a heated roller hearth furnace.

7. A device according to claim 3, wherein the shuttle system (7) comprises transport elements for moving the shuttles, together with the cast slab (3) or preliminary strip (3') transverse to the strip transport direction (F).

8. A device according to claim 7, wherein the transport elements comprise movable carriages.

9. A device according to claim 7, wherein the transport elements comprises walking beam transport elements.

10. A device according to claim 3, wherein the at least two shuttles (7', 7") of the shuttle system (7) are jointly displaced transverse to the strip transport direction (F).

11. A device according to claim 3, wherein the shuttle system (7) comprises means for a longitudinal transport of the cast slab (3) or preliminary strip (3') from one shuttle (7', 7") to another shuttle in the strip transport direction (F) or in an opposite direction.

12. A device according to claim 3, wherein the shuttle system (7) is connected to a roller table (9, 21) for storing the cast slab (3) or preliminary strip (3').

13. A device according to claim 12, wherein the roller table (9, 21) is provided with heat insulation.

14. A device according to claim 12, wherein a heating means (8) is arranged between the roller table (9) and the shuttle system (7).

15. A device according to claim 12, wherein at least one auxiliary storage for storing the cast slab (3) or preliminary strip (3') is arranged adjacent to the roller table (9).

16. A device according to claim 15, wherein the at least one auxiliary storage comprises a holding pit (10).

17. A device according to claim 3, wherein the strip shears (11) are arranged upstream of the shuttle system (7) in the strip transport direction (F).

18. A device according to claim 3, wherein at least one of induction heater and roller hearth furnace (13) is arranged upstream and downstream of the shuttle system (7).

* * * * *